United States Patent [19]

Thie

[11] Patent Number: 4,940,162

[45] Date of Patent: Jul. 10, 1990

[54] ROLLED COIN DISPENSER

[75] Inventor: Matthew G. Thie, Indianapolis, Ind.

[73] Assignee: Autovend, Inc., Indianapolis, Ind.

[21] Appl. No.: 258,662

[22] Filed: Oct. 17, 1988

[51] Int. Cl.[5] ..... G07F 11/44

[52] U.S. Cl. ..... 221/129; 221/196; 221/202; 221/264

[58] Field of Search ..... 221/6, 14, 67, 84, 85, 221/129, 196, 202, 260, 264; 453/17, 32, 41, 44

[56] References Cited

U.S. PATENT DOCUMENTS

| | | | |
|---|---|---|---|
| 452,635 | 5/1891 | Dieterich . | |
| 676,798 | 6/1901 | Mullins . | |
| 703,138 | 6/1902 | Knowlton . | |
| 789,086 | 5/1905 | Diebel . | |
| 1,778,187 | 10/1930 | DuGrenier . | |
| 1,949,040 | 2/1934 | Clausen | 221/84 X |
| 3,158,247 | 11/1964 | Gale | 221/67 X |
| 4,190,066 | 2/1980 | Burnside | 221/129 |
| 4,469,245 | 9/1984 | Fish et al. | 221/225 |

FOREIGN PATENT DOCUMENTS

| | | | |
|---|---|---|---|
| 689683 | 4/1965 | Italy | 221/67 |

*Primary Examiner*—F. J. Bartuska
*Attorney, Agent, or Firm*—Barnes & Thornburg

[57] ABSTRACT

A dispensing apparatus for a change machine has a reservoir for storing cylindrical objects such as rolls of coins or paper money stored in tubes. The reservoir has a bottom through which a slot extends. A dispensing mechanism is located beneath the reservoir and has at least a pair of spaced apart rollers which form a pocket therebetween. The rollers are mounted for reciprocal movement between a loading position and an eject position. An object will fall from the reservoir through the slot in the bottom of the reservoir into the pocket between the rollers. The rollers are reciprocated between the loading position and the eject position to dispense the object. When the rollers are reciprocated, they agitate the objects remaining in the reservoir to prevent jams caused by the objects bridging across the opening in the bottom of the reservoir. Further, the rollers will roll the object as they are reciprocated which helps prevent damage to the object. A circuit for sensing whether the reservoir is empty and whether an object is being dispensed provides signals indicative thereof at a single output.

8 Claims, 3 Drawing Sheets

ROLLED COIN DISPENSER

BACKGROUND AND SUMMARY OF THE INVENTION

This invention relates to machines for dispensing articles, and particularly to machines for dispensing rolls of coins and bills, the bills being contained in tubes, and to an improved dispensing apparatus for use in such machines.

Retail establishments use a substantial amount of coins and small bills, e.g., ones, fives and tens, to make change throughout their business day. In many cases, the amount given out as change substantially exceeds the amount such coins and bills taken in. Consequently, such retail establishments require a ready source of coins and small bills to replenish those given out as change.

Finding a source of coins and small bills is a particular problem for retail establishments which are open outside standard business hours, i.e., 9–5, since banks are closed. Establishments open 24 hours, such as convenience stores and gas stations, are most severely affected by this problem since not only are the banks closed, but there are very few other establishments open during the late night and early morning hours. Keeping a large supply of coins and small bills on hand is one way of solving the problem. However, this creates serious security problems. The retail establishments which are open at odd hours prefer to minimize the amount of cash accessible to the store attendant to reduce not only the amount of money which a robber might be able to get but also to reduce the incentive to rob such establishments. A common practice therefore is to provide a locked safe which the attendant cannot open and into which the attendant deposits cash receipts, keeping only a minimal amount in the cash register. However, minimizing the amount of cash to which the attendant has access increases the chances that the establishment will run out of change.

One solution to this problem has been to provide "change" dispensers in such retail establishments. An example of such a dispenser is the "TACC II" marketed by Tidel Systems. Such change dispensers store rolls of coins and bills held in cylindrical containers such as tubes in a secure environment and dispense the coins or bills only in response to an appropriate input such as an access code entered by the store attendant. Thus, a store attendant can replenish the supply of change in the cash register by entering the appropriate code to which the change dispenser responds by dispensing a roll of coins or a tube of bills, depending upon what was selected.

Such change dispensers could also be advantageously used in establishments such as laundromats where coins are used to actuate machines. In this context, rolled coins could be purchased by the customer inserting an appropriate amount of paper money into the coin dispenser. The coin dispenser would then include the appropriate sensors to validate the amount and legitimacy of the paper money which could be the type of mechanisms conventionally used in dollar bill changers.

It is important that the dispensing apparatus of cylindrical object dispensers consistently dispense the object to be dispensed without damaging the object. One problem which cylindrical object dispensers have faced is that the stored objects "bridge" across the exit in the reservoir in which they are stored thus causing a jam.

Also, if the objects are not handled properly by the dispensing mechanism they can be damaged.

It is an object of this invention to provide a dispensing apparatus for cylindrical objects which has an improved dispensing mechanism which reduces such problems as damage caused to the articles being dispensed by the dispensing mechanism and jams caused by articles bridging in a dispensing chamber which feeds the dispensing mechanism. Such a dispensing apparatus could be used advantageously in the change dispenser described above.

SUMMARY OF INVENTION

This invention is directed to an apparatus for dispensing cylindrical articles, particularly rolled coins and bills stored in tubes shaped like coin rolls. The apparatus has a means for storing the articles to be dispensed. The storage means includes a reservoir for holding the articles, the reservoir having a bottom with an opening extending therethrough. Disposed beneath the reservoir is means for dispensing the articles. The dispensing means includes at least a pair of spaced apart rollers forming a pocket therebetween for receiving an article to be dispensed. Also included is means for mounting the rollers for reciprocal movement underneath the reservoir between a loading position wherein the pocket is beneath the opening in the bottom of the reservoir and an eject position when the object is ejected. Illustratively, the apparatus includes one of the storage means and one of the dispensing means for each variety, i.e., denomination of coins and bills, of cylindrical articles to be dispensed. Also provided is a means for selecting which dispensing means to actuate to dispense cylindrical object of the desired variety.

The apparatus also includes means for reciprocating the roller mounting means to move the rollers between the loading position and the eject position to dispense an article. When the rollers are in the loading position, an article to be dispensed falls from the reservoir into the pocket between the rollers which is positioned beneath the opening or slot in the bottom of the reservoir. The rollers are moved to the eject position where the article falls from the pocket into a eject chute from which it is dispensed from the dispensing apparatus. As the rollers are moved, at least one of the rollers agitates the articles in the reservoir as the rollers are reciprocated between the loading position and the eject position. Finally, the apparatus also includes means for coupling the reciprocating means to the roller mounting means. Further, since rollers are used to move the object from the loading position to the eject position, the object will thus "roll" as it is moved which reduces the possibility that it might be damaged.

Each dispensing apparatus can also include a circuit which both senses whether the reservoir is empty and whether an object is being dispensed and provides signals indicative thereof at a single output.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which:

DETAILED DESCRIPTION

Figure 1:
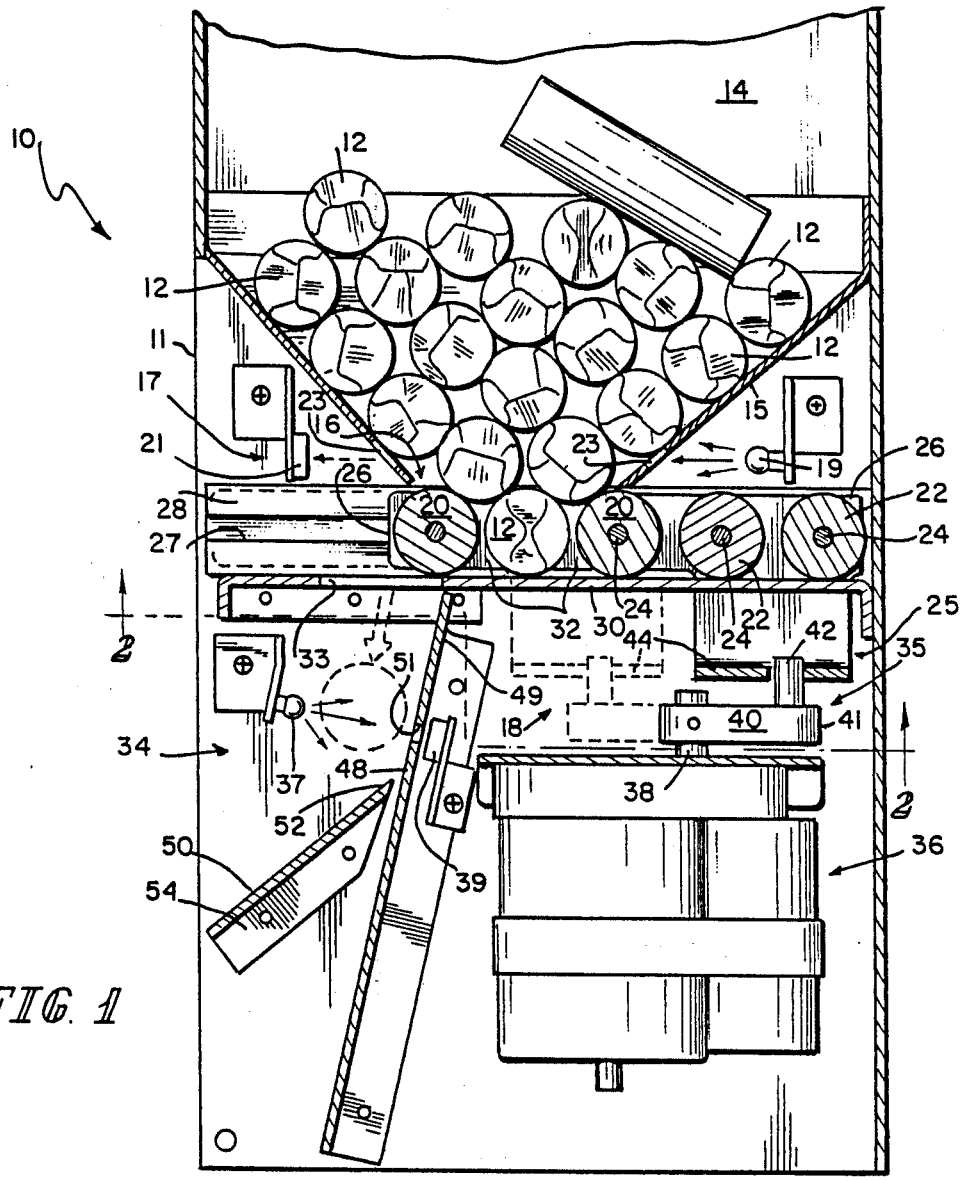
FIG. 1 is a cross-sectional view of an embodiment of a dispensing apparatus of this invention.
Figure 2:
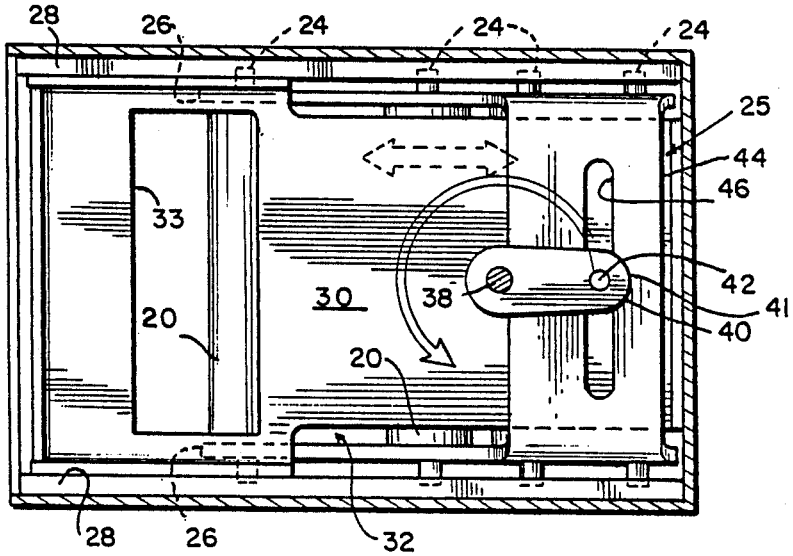
FIG. 2 is a cross-sectional view cut along line 2—2 of FIG. 1.

Referring to FIGS. 1 and 2, an apparatus 10 for dispensing cylindrical objects, such as rolls of coins 12, is shown. It should be understood that the cylindrical objects can also be tubes shaped like coin rolls into which paper money can be placed. The dispensing apparatus 10 includes a case or housing 11. A reservoir 14 is mounted at the top of housing 11 for holding the rolled coins 12. The lower portion of reservoir 14 comprises a chute 15 which at its lower end terminates in an opening or slot 16. A sensor 17 for sensing that reservoir 14 is empty and providing a "sold out" signal is mounted to case 11 at the bottom of chute 15. Illustratively, sold-out sensor 17 comprises a light source 19 and a photo-transistor 21 which are both mounted to case 11 on opposite sides of the bottom of chute 15. Chute 15 includes holes 23 through which the light from light source 19 will pass through to photo-transistor 21 when resevoir 14 is empty. This causes photo-transistor 21 to generate the "sold-out" signal as will be described in more detail later.

Apparatus 10 also includes a roller assembly 18 for dispensing a roll of coins 12 from reservoir 14. Roller assembly 18 is mounted beneath beneath reservoir 14 for reciprocal movement between a loading position shown by the solid lines in FIG. 1 and an eject position shown by the phantom lines in FIG. 1. Roller assembly 18 includes a plurality of spaced apart dispensing rollers 20 which form a pocket 32 therebetween for receiving a roll of coins 12 to be dispensed and a plurality of trailing rollers 22. Each roller 20, 22 has a roller axle 24 on which it rotates. The ends of roller axles 24 are mounted to opposed arms 26 of a roller mounting bracket 25. The ends of roller axles 24 project through opposed arms 26 of roller mounting bracket 25 and ride in grooves 27 of grooved slide plates 28 which guide and support roller assembly 18. Roller mounting bracket 25 has a bottom plate 44 which extends between opposed arms 26 and from which opposed arms 26 extend. Bottom plate 44 has an elongated slot 46 therein.

Dispensing apparatus 10 also includes reciprocating means 35 for reciprocating roller assembly 18. Reciprocating means 35 includes an electric motor 36 mounted to case 11 and which has a drive shaft 38. An eccentric 40 is mounted on drive shaft 38. A post 42 extends upwardly from a distal end 41 of eccentric 40 into elongated slot 46 in the bottom plate 44 of roller mounting bracket 25.

Mounted to case 11 beneath roller mounting bracket 25 of roller assembly 18 is a slide plate 30 which extends transversely across case 11. An eject chute 48 is mounted beneath slide plate 30 such that a proximal end 49 of eject chute 48 abuts slide plate 30 at one edge of an eject slot 33 in slide plate 30. Eject chute 48 extends generally downwardly from eject slot 33 in slide plate 30. A roll counter sensor 34 for sensing the rolls of coins as they are dispensed and providing a signal for incrementing a counter is mounted to case 11 generally below the eject slot 33 in slide member 30. Illustratively, roll counter sensor 34 comprises a photo-transistor 39 mounted behind eject chute 48 and a light source 37 mounted in front of eject chute 48. Eject chute 48 includes a hole 51 in front of photo-transistor 39 through which the light from light source 37 normally shines unless blocked by a roll of coins falling down eject chute 48.

Dispensing apparatus 10 can also include an optional eject chute 50 which has a proximal end 52 abutting a portion of eject chute 48 part way down eject chute 48. Optional eject chute 50 also has a distal end 54 from which the roll of coins 12 will leave dispensing apparatus 10 when it is dispensed.

To dispense a roll of coins 12, electric motor 36 is actuated. Before electric motor 36 is actuated, roller assembly 18 is in a loading position wherein the pocket 32 between dispensing rollers 20 is beneath the opening 16 in the bottom of reservoir 14. A roll of coins 12 will then have fallen through the opening 16 in the bottom of reservoir 14 into pocket 32 and will be supported on slide plate 30. When electric motor 36 is actuated, it rotates eccentric 40. As eccentric 40 rotates, post 42 moves back and forth in the elongated slot 46 in the bottom plate 44 of slide plate 25 and reciprocates slide plate 25 between the loading position and the eject position thus reciprocating roller assembly 18 between the loading position and eject position.

As roller assembly 18 is reciprocated to the eject position, dispensing rollers 20 will move the roll of coins 12 in pocket 32 toward the eject position and, as roller assembly 18 reaches the eject position, dispensing rollers 20 will push the roll of coins 12 in pocket 32 over eject slot 31 in slide plate 30. The roll of coins 12 will fall through eject slot 33 onto eject chute 48 and down eject chute 48. If optional eject chute 50 is present, the roll of coins 12 will fall onto optional eject chute 50 and then out of dispensing apparatus 10 from optional eject chute 50. Of course if optional eject chute 50 is not present, the roll of coins 12 will fall from eject chute 48 out of dispensing apparatus 10. Roller assembly 18 is then reciprocated by electric motor 36 back to its loading position where a new roll of coins 12 will fall into pocket 32 from reservoir 14.

When roller assembly 18 is reciprocated between its loading position and eject position, rollers 20, 22 will agitate the rolls of coins 12 in reservoir 14. As can be seen from FIG. 1, the opening 16 in the bottom of reservoir 14 is wide enough so that the rolls of coins 12 in the bottom of reservoir 14 are actually resting on dispensing rollers 20. As roller assembly 18 is reciprocated, dispensing rollers 20 and trailing rollers 22 move across the opening 16 in the bottom of reservoir 14 and push against the rolls of coins 12 in the bottom of reservoir 14. This agitates the rolls of coins 12 in the bottom of reservoir 14 and helps prevent jams which can be caused by rolls of coins 12 bridging across the opening 16 in the bottom of reservoir 12.

The use of dispensing rollers 20 to move the roll of coins 12 to be dispensed along slide plate 30 helps prevent damage to the coin roll. Since rollers are used as opposed to a fixed member, the roll of coins 12 will roll on slide plate 30 as it is being moved by dispensing rollers 20. By rolling the roll of coins 12, binding and the like is minimized which reduces the possibility that the rolls of coins 12 might be damaged. For example, sliding a roll of coins 12 instead of rolling it increases the possibility that the coin wrapper might be torn.

Figure 3:
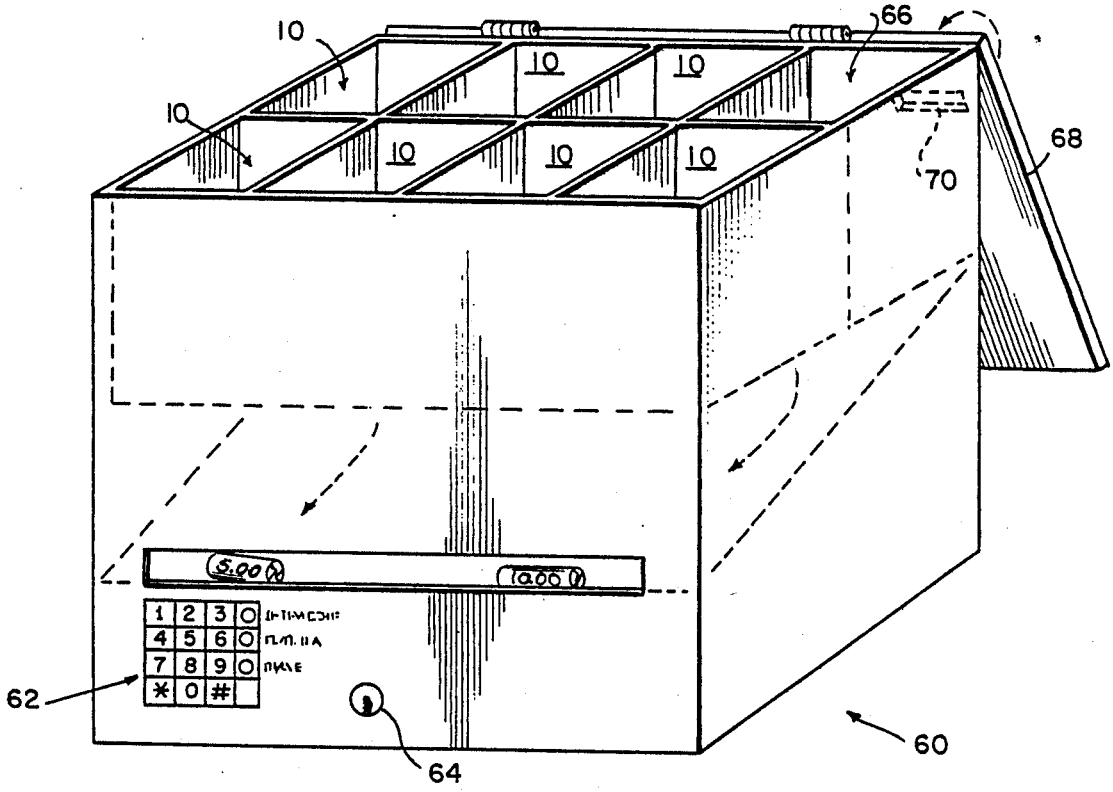
FIG. 3 is a diagrammatic view of a change dispenser incorporating a plurality of the dispensing apparatuses of this invention.

FIG. 3 shows a change machine 60 which includes a plurality of dispensing apparatuses 10. Illustratively, change machine 60 includes seven dispensing apparatuses 10 wherein the dispensing apparatuses 10 dispense rolled pennies, nickels, dimes, quarters, one dollar bills, five dollar bills and ten dollar bills, respectively. The rolls 20, 22 of dispensing apparatuses 10, and the spaces between the dispensing rolls 20, are sized in relation to the item the dispensing apparatuses 10 will dispense. Illustratively, the rolls 20, 22 and the spaces between the dispensing rolls 20 of the dispensing apparatuses 10 would have two sizes. The larger size would be for dispensing apparatuses 10 which are used to dispense quarters and the cylinders or tubes into which paper money is placed in that such tubes would have approximately the same dimensions as a roll of quarters. The smaller size would be for dispensing apparatuses 10 which are used to dispense pennies, nickels and dimes.

Change machine 60 would also include a keypad 62 which would be coupled to a controller, not shown, which controls change machine 60. The controller would illustratively comprise a microprocessor based control system which would implement an algorithm for controlling change machine 60 which will be discussed in greater detail later. Change machine 60 would also include a key switch 64 coupled to the controller.

Change machine 60 can also include a safe 66 for storing accumulated cash in a secure environment. Illustratively, change machine 60 would have an access panel on a door 68 which would normally cover the top of change machine 60 and be locked in place thus preventing access to any of dispensing apparatuses 10 or safe 66. When the cash receipts in the cash register reach a certain amount, the store attendant would deposit the excess amount of cash into safe 66 by dropping it through a slot 70 in access door 68. To service change machine 60, i.e., refill dispensing apparatuses 10 or empty safe 66, access door 68 is opened, as shown in FIG. 3.

Figure 4:
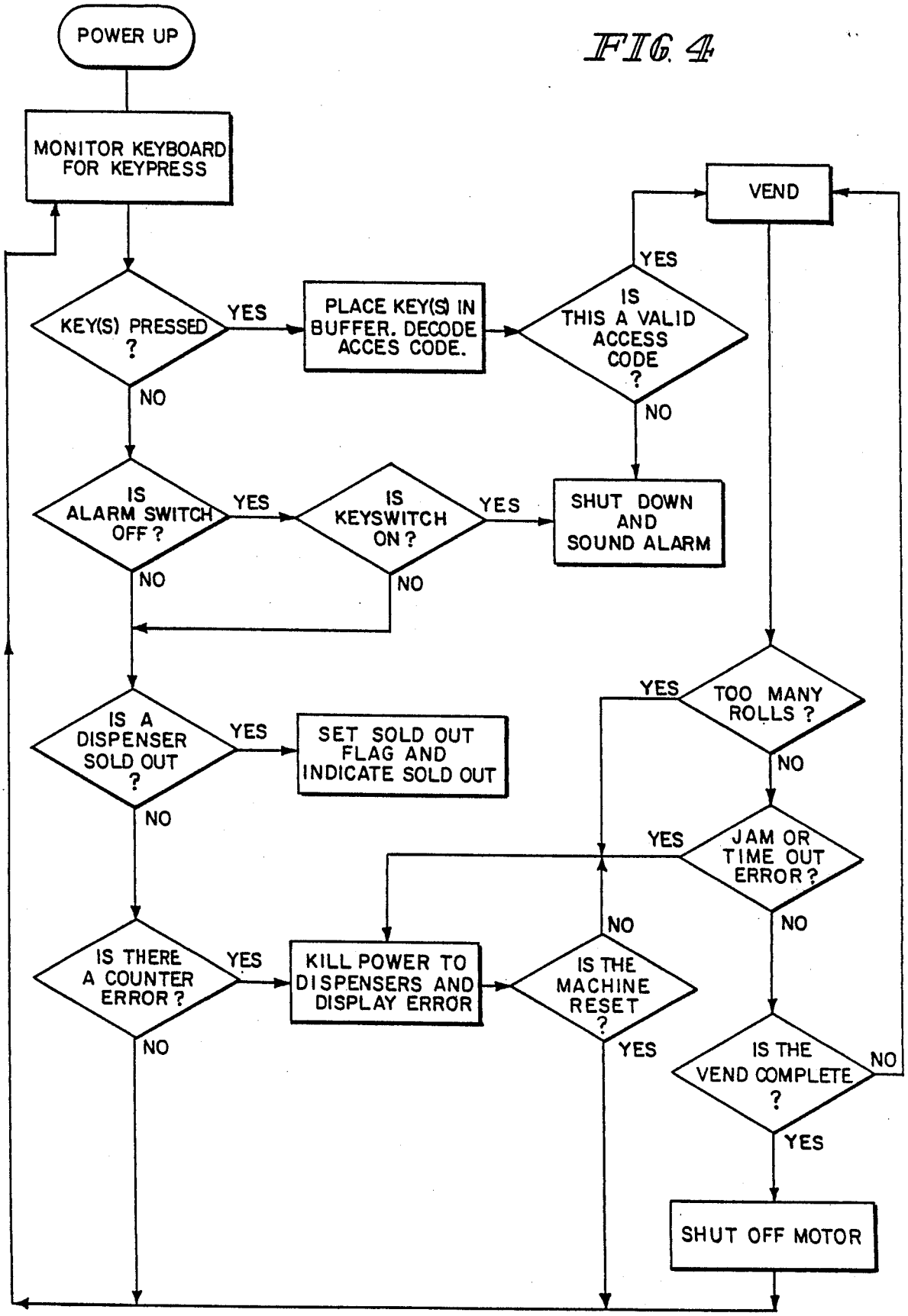
FIG. 4 is a flow chart of a program which could be used to control the change dispenser of FIG. 3.

FIG. 4 is a flow chart of a control algorithm for controlling change machine 60 which would be implemented by the microprocessor based control system. The first step in the control algorithm is monitoring the keypad 62 to see if an access code has been entered, i.e., one or more keys pressed. If an access code has been entered, the program then places the key(s) which have been pressed into a buffer and decodes the access code which was just entered. Next, the access code is checked to determine if it is a valid access code. If the access code is invalid, an unauthorized access is being attempted and the machine is shut down and an alarm sounded. Note, however, that a finite number of retries may be permitted to enter a valid access code to accommodate mistakes made when entering an access code.

If the access code is valid, an appropriate one of the plurality of dispensing apparatuses 10 is actuated in the vend step to dispense a roll of coins or a tube of bills. Illustratively, the access code in addition to determining whether change machine 60 will be activated at all would also determine which dispensing apparatus 10 is to be actuated to select the particular value of coins or bills to be dispensed. Next, a check is made for "too many rolls?" to see whether too many of the selected item have been dispensed in a given time period. Each time a dispensing apparatus 10 dispenses one of its items, its respective roll counter sensor 34 (FIG. 1) provides a signal to the controller and the controller increments a counter for that dispensing apparatus 10. If the counter for the dispensing apparatus 10 which has just been actuated is incremented too often in a given period of time, this indicates that the dispensing apparatus 10 has failed and power is turned off and an error displayed. Once this has occurred, the change machine 60 must be reset before it can be used again.

If the "too many rolls?" step is successfully passed, a check is next made to see if the actuated dispensing apparatus 10 has jammed or has experienced a time out error. If the controller has received a signal from the roll counter sensor 34 for the actuated dispensing apparatus 10 within a given time period, such as sixteen seconds, no time out error has occurred and a check is then made to see if the vend is complete. If no such signal has been received, a time out error has occurred which indicates that the selected dispensing apparatus 10 has been actuated long enough to dispense an article but has not. This indicates the selected dispensing apparatus 10 has experienced a failure, such as jamming. Power is then shut off and an error displayed. If the vend is complete, the motor 36 of the actuated dispensing apparatus 10 is shut off and the control sequence returns to the first step where the keyboard is being monitored to see if an access code has been entered. If the vend is not complete, the "vend" step is repeated.

Returning to the decision block where a check is made to see if a key has been pressed, if one has not, a check in then made to see if an alarm switch is off. The alarm switch is a switch which is actuated by the access panel or door 68 of the change machine 60. When the access panel 68 is open, the alarm switch would illustratively be off. If the alarm switch is off, a check is next made to see if keyswitch 62 is on. If it is, change machine 60 is shut down and the alarm sounded. When change machine 60 is in normal operation, keyswitch 62 is on and the key removed. When the access panel or door to change machine 60 is opened such as during service, keyswitch 62 is turned off. Therefore, if keyswitch 62 is not off when the access panel or door is opened, an unauthorized access is being attempted such as might happen if the change machine 60 was being burglarized.

If the keyswitch 62 was not on, a check is made to see if any of the dispensing apparatus 10 are sold out as is the case if the alarm switch was not off. Sold out sensor 17 is used to determine whether its respective dispensing apparatus 10 is sold out as will be described in more detail below. If a dispensing apparatus 10 is sold out, an appropriate flag is set in the controller to indicate this and an appropriate indicator is actuated to signal that a dispensing apparatus 10 is sold out.

If no dispensing apparatus 10 was sold out, a counter error check is next made to make sure that items are not being dispensed when the dispensing apparatuses 10 are not in the vend mode. If a signal from a roll count sensor 34 of any of the dispensing apparatuses 10 is received when that dispensing apparatus 10 is not in the vend mode, it indicates that the dispensing apparatus 10 has failed because it is dispensing items when no request has been made for such items. If the counter error check is positive, power to the dispensing apparatuses 10 is turned off and an appropriate error display generated. If the counter error check is negative, the control sequence return to the step where it is monitoring the keyboard.

Figure 5:
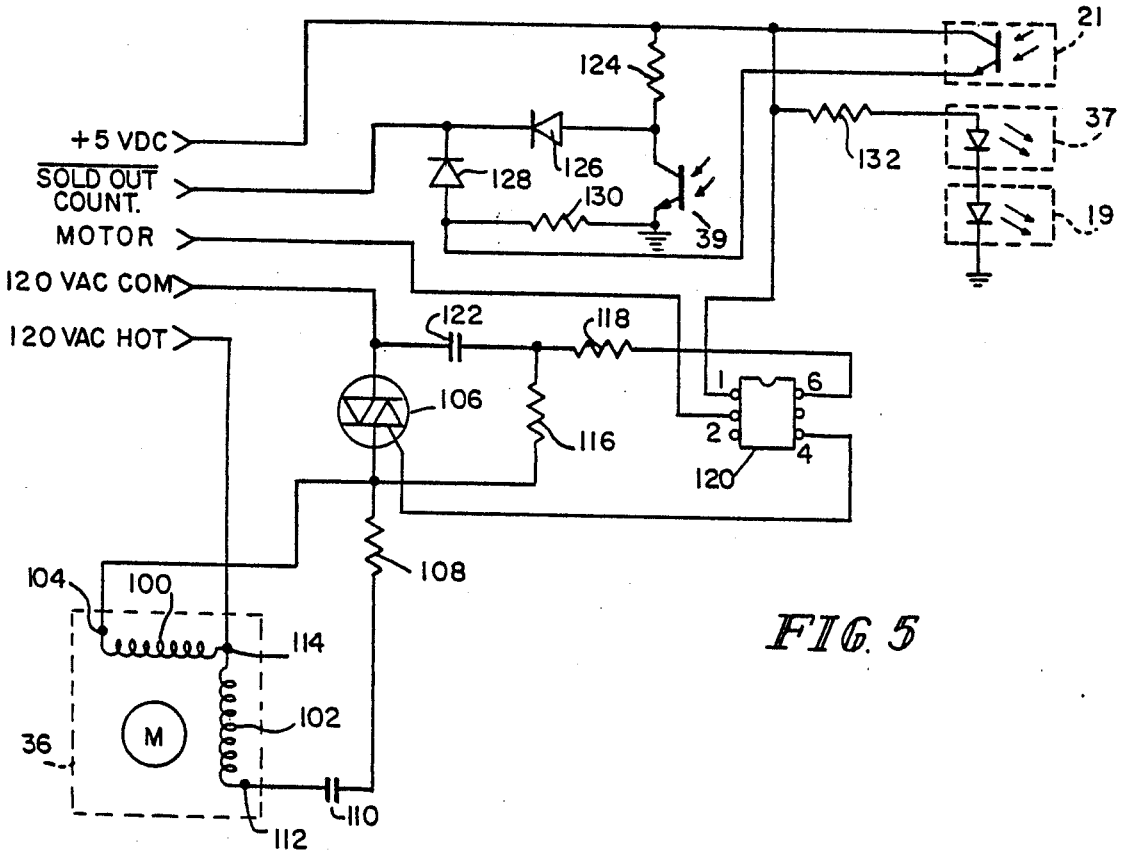
FIG. 5 is a schematic of a circuit for sensing whether the reservoir is empty and whether an object has been dispensed and for controlling the motor of the dispensing apparatus of FIG. 1.

FIG. 5 is a schematic of an electronic circuit that each dispensing apparatus 10 has for sensors 17 and 34 and for actuating its electric motor 36. Electric motor 36 includes a first winding 100 and a second winding 102. A first terminal 104 of first winding 100 is coupled to a first terminal of a triac 106 and through a five watt, 4.3 ohm resistor 108 and a 10 μfd capacitor 110 to a first terminal 112 of second winding 102. Second terminals of first winding 100 and second winding 102 are coupled together at 114 and are also coupled to the hot line of a source of 120 VAC (not shown). The common line of the source of 120 VAC is coupled to a second terminal of triac 106. The second terminal of triac 106 is also coupled through a 0.1 μFD capacitor 122 and through a 180 ohm resistor 118 to pin 6 (one of the "main" terminals) of an optically isolated triac driver 120 which is illustratively a MOC 3010 manufactured by Motorola Semiconductor Products, Inc, P.O. Box 20912, Phoenix, Ariz. 85036. The junction of resistor 118 and capacitor 122 is coupled through a 27K resistor 116 to the first terminal of triac 106. Pin 4 (the other "main" terminal) of optically isolated triac driver 120 is coupled to the gate terminal of triac 106. Pin 1 (the anode terminal) of optically isolated triac driver 120 is coupled to a source of +5 VDC (not shown). Pin 2 (the cathode terminal) of optically isolated triac driver 120 is coupled to a motor actuation output (not shown) of the controller (not shown) for change maker 60.

Photo-transistor 39 of roll count sensor 34 has an emitter coupled to ground and a collector coupled through a 150K resistor 124 to the source of +5 VDC (not shown) and to the anode of a diode 126. The cathode of diode 126 is coupled to the cathode of a diode 128. The anode of diode 128 is coupled to the emitter of photo-transistor 21 of sold out sensor 17 and through a 100K resistor 130 to ground. The collector of photo-transistor 21 is coupled to the source of +5 VDC (not shown). The junction of the cathodes of diodes 126, 128 is coupled to a $\overline{\text{sold out}}$/count input of the controller (not shown) of change machine 60. The outputs of both the sold out sensor 17 and the roll count sensor 34 are provided at the junction of the cathodes of diodes 126, 128 as will be explained in more detail later.

Light source 37 of roll count sensor 34 is a light emitting diode which has its anode coupled through a 150 ohm resistor 132 to the source of +5 VDC and its cathode coupled to the anode of a light emitting diode which is the light source 19 of sold out sensor 17. The cathode of the light emitting diode which is light source 19 is coupled to ground.

In operation, when the controller of change machine 60 determines to actuate a particular dispensing apparatus 10, it asserts the motor actuation output for that particular dispensing apparatus 10 by bringing it low. This low signal is coupled through optically isolated triac driver 120 to the gate of triac 106 which turns triac 106 on. This connects the motor 36 of the selected dispensing apparatus 10 to the source of 120 VAC which turns it on. To turn the motor 36 off, the controller of change maker 60 brings the appropriate motor actuation output high which turns triac 106 off and disconnects the motor 36 from the source of 120 VAC.

Sold out sensor 17 and roll count sensor 34 operate as follows. When a roll of coins is in chute 15 of reservoir 14, light source 19 of sold out sensor 17 is blocked. This biases photo-transistor 21 off so that diode 128 is reverse biased and its cathode floats. When chute 15 is empty, light source 19 of sold out sensor 17 is no longer blocked and biases photo-transistor 21 on. This pulls the emitter of photo-transistor 21 high which forward biases diode 128 which brings the cathode of diode 128 high.

Normally, light source 37 of roll count sensor 34 is not blocked so photo-transistor 39 of roll count sensor 34 is biased on. This pulls the collector of photo-transistor 39 low which reverse biases diode 126 so that its cathode floats. When a roll of coins is dispensed from dispensing apparatus 10, it falls down eject chute 48 and momentarily blocks light source 37 of roll count sensor 34. When light source 37 is blocked, photo-transistor 39 is biased off and its collector is pulled high. This forward biases diode 126 which brings its cathode high. As soon as the roll of coins passes light source 37, photo-transistor 39 is turned on again which reverse biases diode 126 and its cathode floats.

The controller of change maker 60 monitors the junction of the cathode of diodes 126, 128 which provides both a count signal to the controller for incrementing a roll counter for that dispensing apparatus 10 and also a sold out signal to indicate that the dispensing apparatus 10 is sold out, that is, reservoir 14 is empty. When this junction goes high momentarily, controller 60 interprets this as a count signal and increments the roll counter for that dispensing apparatus 10. However, when this junction goes high and remains high, the controller interprets this as a sold out signal indicating that the reservoir 14 of the dispensing apparatus 10 is empty and takes the appropriate steps as discussed above.

Although the invention has been described in detail with reference to certain preferred embodiments and specific examples, variations and modifications exist within the scope and spirit of the invention as described and as defined in the following claims.

What is claimed is:

1. An apparatus for dispensing cylindrical objects, comprising:

means for storing the articles to be dispensed including a reservoir for holding the articles to be dispensed having a bottom with an opening extending therethrough;

means for dispensing the articles, the dispensing means disposed beneath the reservoir;

the dispensing means including at least a pair of spaced apart rollers forming a pocket therebetween for receiving an article to be dispensed, means for mounting the rollers for reciprocal movement underneath the reservoir between a loading position wherein the pocket is beneath the opening in the bottom of the reservoir and an eject position;

means for reciprocating the roller mounting means between the loading position and the eject position to permit an article to be dispensed to move into the pocket when the rollers are in the loading position and to dispense the article from the apparatus when the rollers are in the eject position and also to agitate the articles in the reservoir by at least one of the rollers as the rollers are reciprocated between the loading position and the eject position;

means for coupling the reciprocating means to the roller mounting means, an eject chute mounted at the eject position; and a slide member mounted beneath the rollers and extending from beneath the opening in the bottom of the reservoir to an inlet of the eject chute;

the article to be dispensed riding on the slide member when being moved by the rollers and being pushed into the eject chute from the slide member by the rollers to dispense the article from the apparatus.

2. The apparatus of claim 1 wherein the reservoir has a lower end which includes a chute with the opening through the bottom of the reservoir at the lower end of the chute.

3. The apparatus of claim 1 wherein the articles to be dispensed are rolled coins and tubes shaped like coin rolls for holding paper money.

4. The apparatus of claim 3 and further including one of the storage means and one of the dispensing means for each denomination of rolled coins to be dispensed by the apparatus and means for selecting which dispensing means to actuate to dispense a roll of coins of a selected denomination.

5. The apparatus of claim 1 wherein the rollers include a third roller mounted adjacent one of said pair of spaced apart rollers for reciprocating therewith, the third roller agitating the articles in the reservoir as the rollers are reciprocated between the loading position and eject position.

6. An apparatus for dispensing cylindrical objects, comprising:

means for storing the articles to be dispensed including a reservoir for holding the articles to be dispensed having a bottom with an opening extending therethrough;

means for dispensing the articles, the dispensing means disposed beneath the reservoir;

the dispensing means including at least a pair of spaced apart rollers forming a pocket therebetween for receiving an article to be dispensed, means for mounting the rollers for reciprocal movement underneath the reservoir between a loading position wherein the pocket is beneath the opening in the bottom of the reservoir and an eject position;

means for reciprocating the roller mounting means between the loading position and the eject position to permit an article to be dispensed to move into the pocket when the rollers are in the loading position and to dispense the article from the apparatus when the rollers are in the eject position and also to agitate the articles in the reservoir by at least one of the rollers as the rollers are reciprocated between the loading position and the eject position; and means for coupling the reciprocating means to the roller mounting means, the roller mounting means comprising a roller mounting bracket to which the rollers are rotatably mounted and the reciprocating means comprising an eccentric coupled to the roller mounting bracket and means for rotating the eccentric to reciprocate the roller mounting bracket between the loading position and the eject position.

7. An apparatus for dispensing rolls of different denominations of rolled coins and paper money stored in tubes comprising a reservoir for holding each denomination to be dispensed, each reservoir having a bottom with an opening extending therethrough;

means for dispensing each denomination, the dispensing means for a particular denomination disposed beneath the respective reservoir for each denomination, the dispensing means including at least a pair of spaced apart rollers forming a pocket therebetween for receiving a roll and means for mounting the rollers for reciprocal movement underneath the respective reservoir between a loading position wherein the pocket is beneath the opening in the bottom of the reservoir and an eject position, the roller mounting means comprising a roller mounting bracket to which the rollers are rotatably mounted, and further including an eject chute mounted at the eject position, a slide member mounted beneath the rollers and extending from beneath the opening in the bottom of the reservoir to an inlet of the eject chute, the coin roll riding on the slide member when moved by the rollers and being pushed into the eject chute from the slide member by the rollers to dispense the roll from the apparatus;

each dispensing apparatus having means for reciprocating its roller mounting means between the loading position and the eject position to permit a roll to move into the pocket when the rollers are in the loading position and to dispense the roll from the apparatus when the rollers are in the eject position and also to agitate the rolls in the reservoir by at least one of the rollers as the rollers are reciprocated between the loading position and the eject position, and means for selecting which dispensing means to actuate to dispense a roll of a selected denomination.

8. The apparatus of claim 7 wherein the reciprocating means of each dispensing apparatus includes an eccentric coupled to the roller mounting bracket and means for rotating the eccentric to reciprocate the roller mounting bracket between the loading position and the eject position.

* * * * *